US010563940B2

(12) United States Patent
Hudson, III et al.

(10) Patent No.: US 10,563,940 B2
(45) Date of Patent: Feb. 18, 2020

(54) FIREARMS SLIDE SERRATIONS

(71) Applicant: Skunk Labs LLC, Georgetown, TX (US)

(72) Inventors: Billie Cyril Hudson, III, Georgetown, TX (US); Lauren Hudson, Georgetown, TX (US); Kevin Michael Blanford, Louisville, KY (US)

( * ) Notice: Subject to any disclaimer, the term of this patent is extended or adjusted under 35 U.S.C. 154(b) by 0 days.

(21) Appl. No.: 15/783,728

(22) Filed: Oct. 13, 2017

(65) Prior Publication Data

US 2018/0106566 A1 Apr. 19, 2018

Related U.S. Application Data

(60) Provisional application No. 62/407,775, filed on Oct. 13, 2016.

(51) Int. Cl.

| | |
|---|---|
| ***F41A 3/72*** | (2006.01) |
| ***F41C 27/00*** | (2006.01) |
| ***F41C 3/00*** | (2006.01) |
| ***F41A 35/00*** | (2006.01) |
| ***F41A 35/06*** | (2006.01) |
| ***F41A 3/64*** | (2006.01) |

(52) U.S. Cl.

CPC ..... *F41A 3/72* (2013.01); *F41A 3/64* (2013.01); *F41A 35/00* (2013.01); *F41A 35/06* (2013.01); *F41C 3/00* (2013.01); *F41C 27/00* (2013.01)

(58) Field of Classification Search

CPC .... F41A 3/72; F41A 3/64; F41A 35/00; F41A 35/06; F41C 3/00; F41C 27/00

USPC ..... 42/14

See application file for complete search history.

(56) References Cited

U.S. PATENT DOCUMENTS

| | | | | |
|---|---|---|---|---|
| 5,275,084 | A * | 1/1994 | Ruger | F41A 3/64 89/196 |
| 9,328,991 | B2 * | 5/2016 | Gale | F41C 27/00 |
| 2005/0011349 | A1 * | 1/2005 | Rohrbaugh | F41A 5/04 89/147 |
| 2014/0047753 | A1 * | 2/2014 | Grossman | F41A 3/66 42/72 |
| 2014/0338522 | A1 * | 11/2014 | Bellione | F41A 3/12 89/139 |

OTHER PUBLICATIONS

Product Sheet for Springfield Armory XDM series pistol (Year: 2007).*

* cited by examiner

*Primary Examiner* — Samir Abdosh
(74) *Attorney, Agent, or Firm* — Matthew E. Burr

(57) ABSTRACT

A firearm slide and a firearm having a slide has a rail portion along which a slide moves translationally, the slide provides a plurality of serrations. The slide has a height and each serration of the plurality of serrations is cut into the slide along the entire height of the slide. The slide defines a horizontal axis and the plurality of serrations are angled relative to the horizontal axis. The serrations are in groups of serrations separated by one or more unserrated portions of the slide. The serrations being configured to maximize the thickness of the slide portion in the rail portion.

2 Claims, 9 Drawing Sheets

FIREARMS SLIDE SERRATIONS

CROSS-REFERENCE TO RELATED APPLICATIONS

The present application is related to, a continuation-in-part of, claims the benefit of and priority from U.S. provisional patent application Ser. No. 62/407,775, filed Oct. 13, 2016, of the same title and by the same inventors.

TECHNICAL FIELD

This disclosure relates generally to firearms and more particularly to slide serrations for a pistol.

BACKGROUND

Pistols traditionally have a slide, with few notable exceptions, which translates forward and backward during the process of firing, ejecting and reloading a round into the chamber. Most slides have serrations that assist in gripping the slide in order to manually eject or load a round into the chamber. These serrations are usually as deep as possible without compromising the integrity of the slide.

In the present invention, the slide serrations have been optimized in order to provide the maximum amount of purchase area, the bottom to the top of the slide, and a greater amount of gripping surface area, depth of the cuts, without compromising the integrity of the slide.

SUMMARY

Slide serrations are cut into the slide along the full height of the slide and at an angle in such a way as to maximize the thickness of the slide in the rail portion to the extent possible within engineering constraints. The serrations are cut into the slide behind the firing chamber and in front of the chamber. Serrations are cut into the right and left sides of the slide.

The advantages provided by the slide serrations of the present invention include preserving material cross-sections; strengthening the slide with improved thickness in the rail; reducing stress concentrations through said thicknesses; minimizing stress fractures in the slide due to fatigue and shock during cycling; and increasing operational life of the slide.

In addition to providing an aesthetically pleasing feature to the weapon, slide cuts of the present invention provide the further advantages of allowing the user maximum purchase of the slide grips due to the discontinuity of the cuts outside of the serration area thereby having the full thickness of the slide at the origin and destination of each slide serration group, and providing increased gripping surface area for the user to operate the pistol. The cuts also serve as a lightening feature that reduces the overall weight of the slide.

BRIEF DESCRIPTION OF THE DRAWINGS

For a more complete understanding of the present disclosure, and the advantages thereof, reference is now made to the following descriptions taken in conjunction with the accompanying drawings, in which.

DETAILED DESCRIPTION

The following discussion is directed to various embodiments of the invention. The term "invention" is not intended to refer to any particular embodiment or otherwise limit the scope of the disclosure. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

In the following discussion and in the claims, the terms "including" and "comprising" are used in an open-ended fashion, and thus should be interpreted to mean "including, but not limited to." Also, the term "connect" or "connected" where used if at all is intended to mean either an indirect or direct connection. Thus, if a first component connects to a second component, that connection may be through a direct connection or through an indirect connection via other components and connections.

Certain terms are used throughout the following description and claims to refer to particular system components and method steps. As one skilled in the art will appreciate, different companies may refer to a component by different names. This document does not intend to distinguish between components that differ in name but not function.

Slide Serration Cuts

Slide serrations are cut through the full height of the slide at an angle. Vertical cross-sections of the angled serrations are shown in FIGS. 4-9.

Slide Serration Angled Cuts

Slide serrations are cut through the full height of the slide. The cuts are made at an angle (dimension "B"), as indicated in FIGS. 10-14, such that thickness through the rail section (dimension "A"), also indicated in FIGS. 4-13, is maximized where possible, thereby a number of advantages:

1. preserving material cross-sections;
2. reducing stress concentrations through said thicknesses;
3. minimizing stress fractures in the slide due to fatigue and shock during cycling; and
4. increasing operational life of the slide.

Slide cuts (dimension "C"), called out in FIGS. 4-7, 11-14, also provide a number of advantages:

1. an aesthetically pleasing feature to the weapon;
2. allow the user maximum purchase of the slide grips due to the discontinuity of the cuts outside of the serration area. The discontinuity forms serration groups behind and in front of the chamber and on both sides of the slide. The full thickness of the slide at the origin and destination of each slide serration group; and
3. serve as a lightening feature, minimizing overall slide weight.

Figure 1:
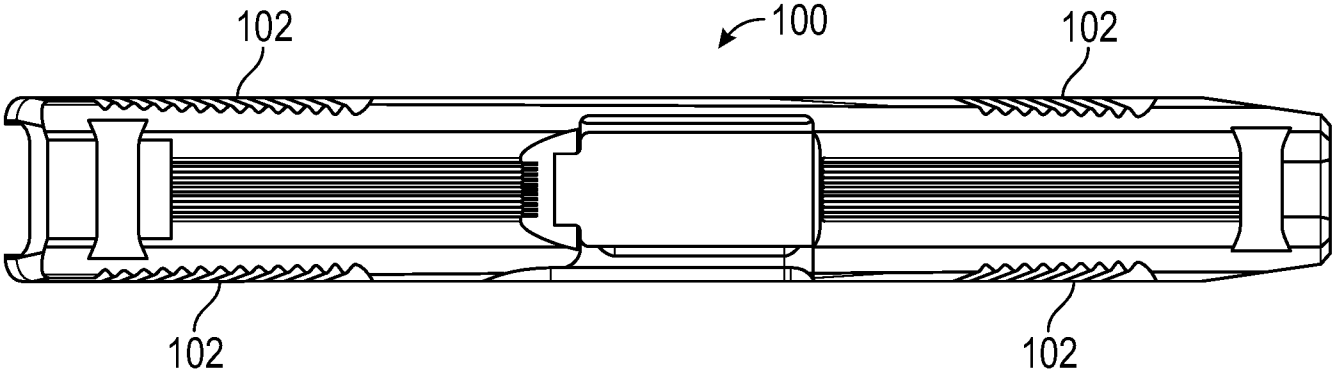
FIG. 1 is a top plan view illustration of a pistol firearm having slide serrations of the present invention.

Turning now to the Figures, FIG. 1 is a top plan view illustration of a pistol firearm 100 having slide serrations 102 of the present invention.

Figure 2:
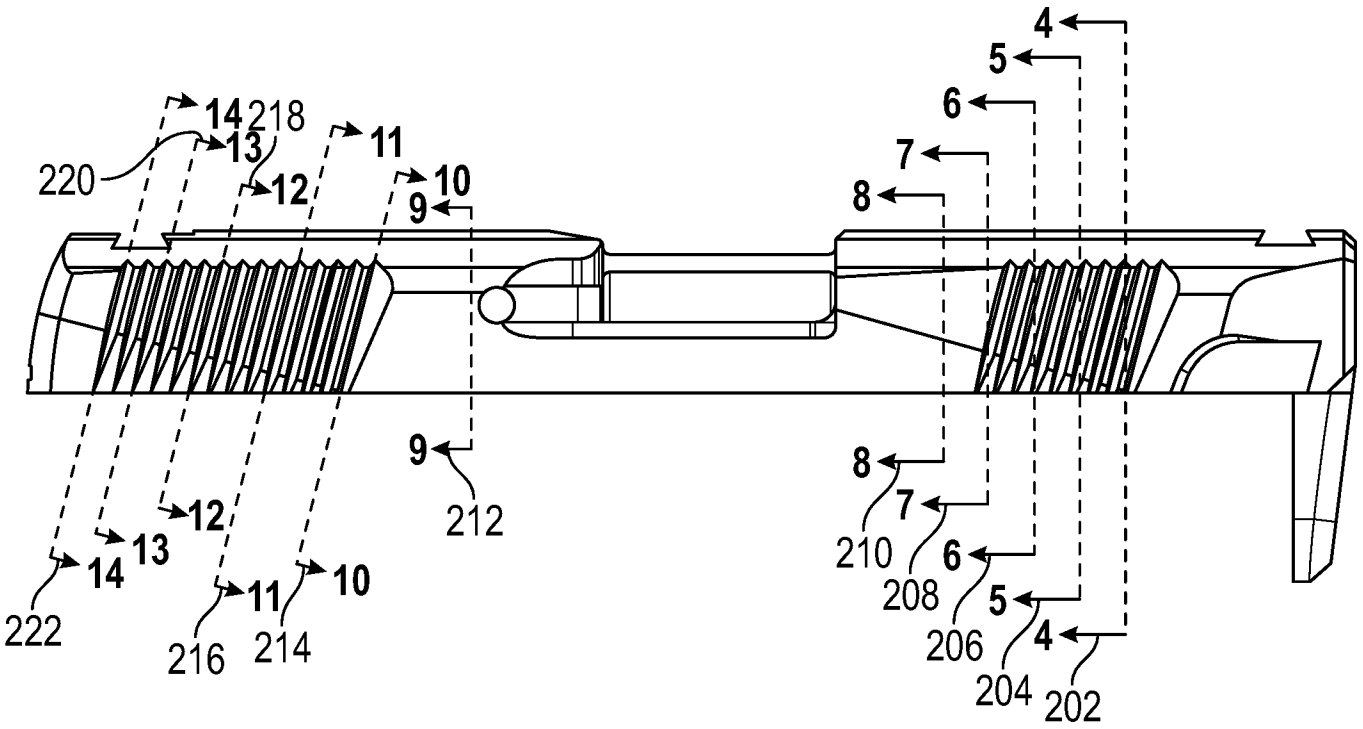
FIG. 2 is a side view illustration of a pistol slide of the present invention.

FIG. 2 is a side view illustration of a pistol slide of the present invention with section lines A-A 202, B-B 204, C-C 206, D-D 208, E-E 210, F-F 212, G-G 214, H-H 216, I-I 218, J-J 220 and K-K 222. Section lines A-A 202 through E-E 210 are vertical sections. Section lines F-F 212 through K-K 222 are angled sections.

Figure 3:
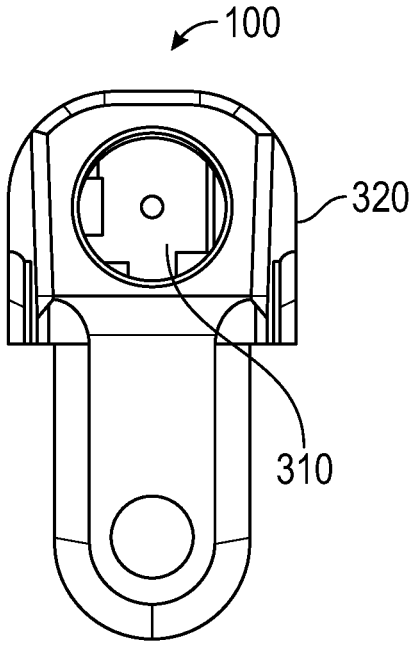
FIG. 3 is a is a front view cross-section illustration of a pistol firearm of the present invention.

FIG. 3 is a is a front view cross-section illustration of a pistol firearm of the present invention. Barrel section 310 through slide 320 are called out for orientation.

Figure 4:
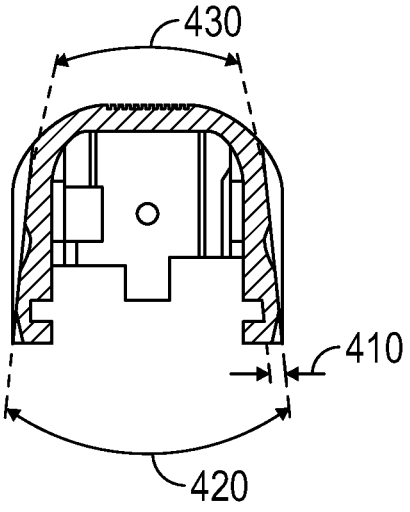
FIG. 4 is a front vertical cross-section view illustration along section line A-A of FIG. 2.

FIG. 4 is a front vertical cross-section view illustration along section line A-A 202 of FIG. 2. Distance "A" 410 is the rail thickness of the serration at section A-A 202. Angle "B" 420 is the cut angle of the serration at section A-A 202, and angle "C" 430 is the angle of the slide 320 at section A-A 202.

Figure 5:
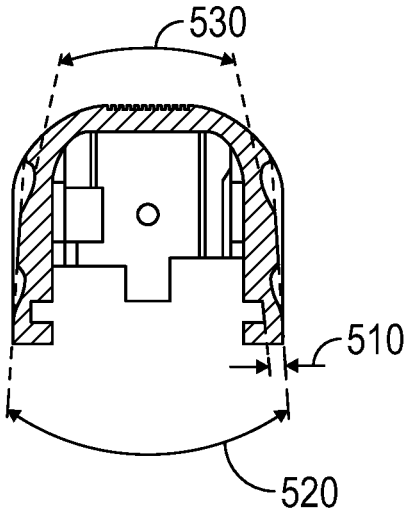
FIG. 5 is a front vertical cross-section view illustration along section line B-B of FIG. 2.

FIG. 5 is a front vertical cross-section view illustration along section line B-B 204 of FIG. 2. Distance "A" 510 is the rail thickness of the serration at section B-B 204. Angle "B" 520 is the cut angle of the serration at section B-B 204, and angle "C" 530 is the angle of the slide 320 at section B-B 204.

Figure 6:
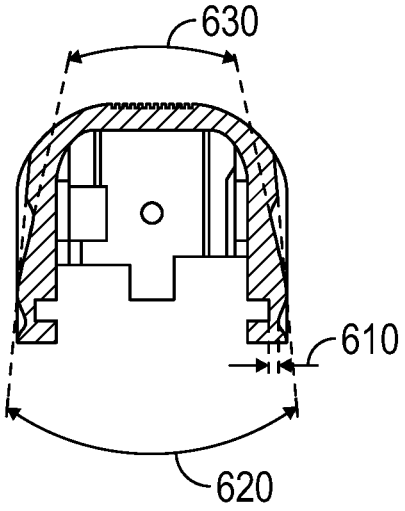
FIG. 6 is a front vertical cross-section view illustration along section line C-C- of FIG. 2.

FIG. 6 is a front vertical cross-section view illustration along section line C-C 206 of FIG. 2. Distance "A" 610 is the rail thickness of the serration at section C-C 206. Angle "B" 620 is the cut angle of the serration at section C-C 206, and angle "C" 630 is the angle of the slide 320 at section C-C 206.

Figure 7:
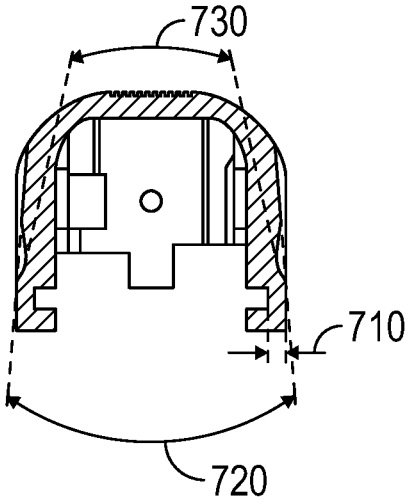
FIG. 7 is a front vertical cross-section view illustration along section line D-D- of FIG. 2.

FIG. 7 is a front vertical cross-section view illustration along section line D-D 208 of FIG. 2. Distance "A" 710 is the rail thickness of the serration at section D-D 208. Angle "B" 720 is the cut angle of the serration at section D-D 208, and angle "C" 730 is the angle of the slide 320 at section D-D 208.

Figure 8:
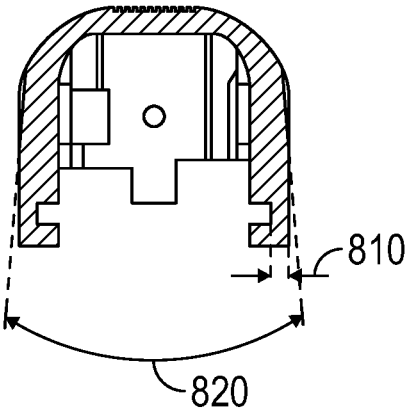
FIG. 8 is a front vertical cross-section view illustration along section line E-E of FIG. 2.

FIG. 8 is a front vertical cross-section view illustration along section line E-E 210 of FIG. 2. Distance "A" 810 is the rail thickness of the serration at section E-E 210. Angle "B" 820 is the cut angle of the serration at section E-E 210.

Figure 9:
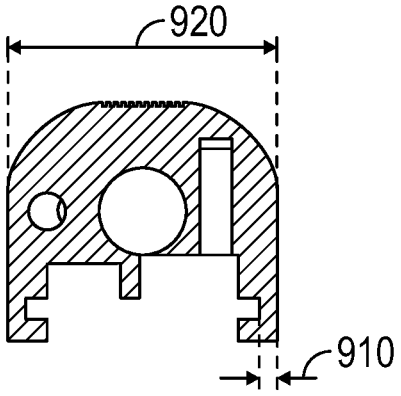
FIG. 9 is a front vertical cross-section view illustration along section line F-F- of FIG. 2.

FIG. 9 is a front vertical cross-section view illustration along section line F-F 212 of FIG. 2. Distance "A" 910 is the maximum rail thickness of the serration at section F-F 212. Angle 920 is the maximum slide angle width at section F-F 212.

Figure 10:
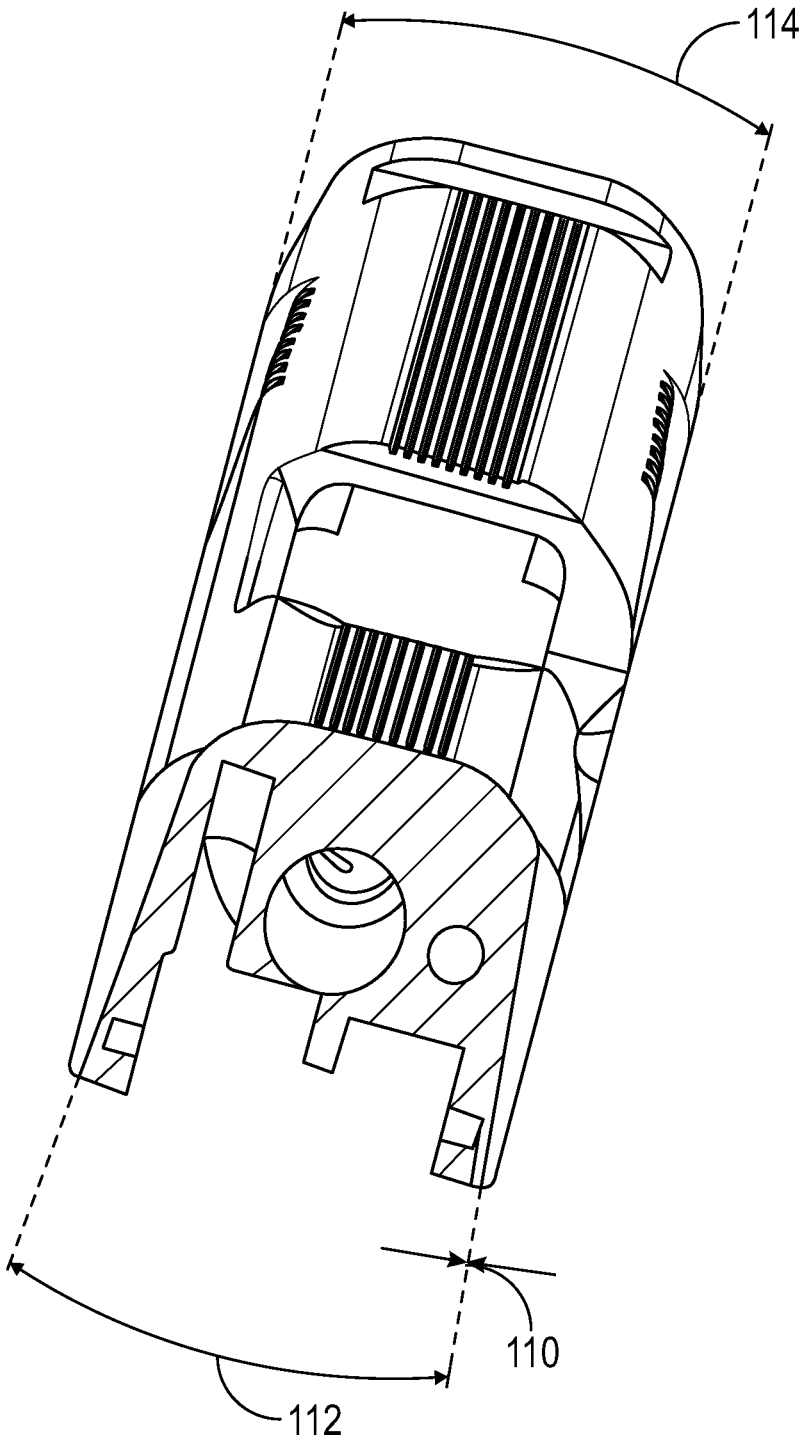
FIG. 10 is a front angled cross-section view along illustration section line G-G of FIG. 2.

FIG. 10 is a front angled cross-section view illustration along section line G-G 214 of FIG. 2. Distance "A" 110 is the rail thickness at section G-G 214. Distance "B" 112 is the angle of the serration cut at section G-G 214. Distance 114 is the slide angle width at maximum.

Figure 11:
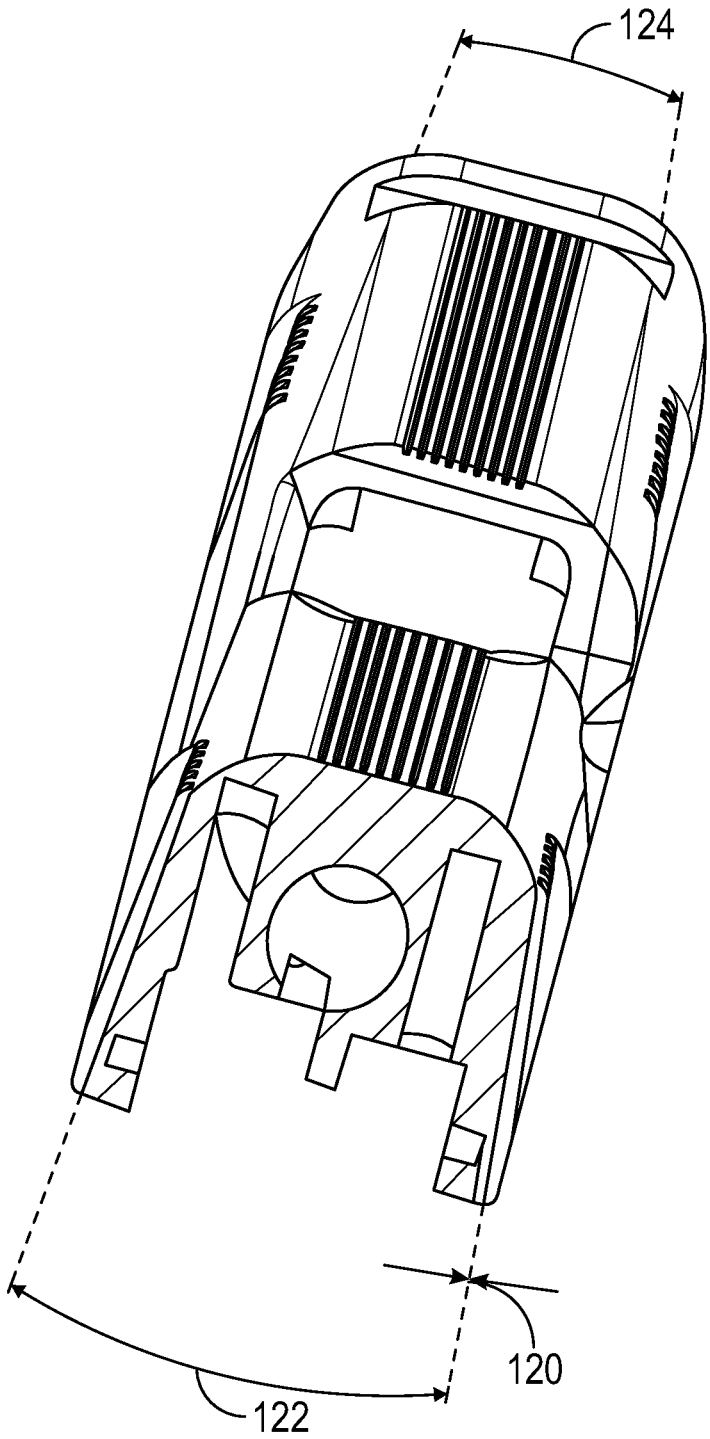
FIG. 11 is a front angled cross-section view illustration along section line H-H of FIG. 2.

FIG. 11 is a front angled cross-section view illustration along section line H-H 216 of FIG. 2. Distance "A" 120 is the rail thickness at section H-H 216. Distance "B" 122 is the angle of the serration cut at section H-H 216. Distance 124 is the slide cut angle at section H-H 216.

Figure 12:
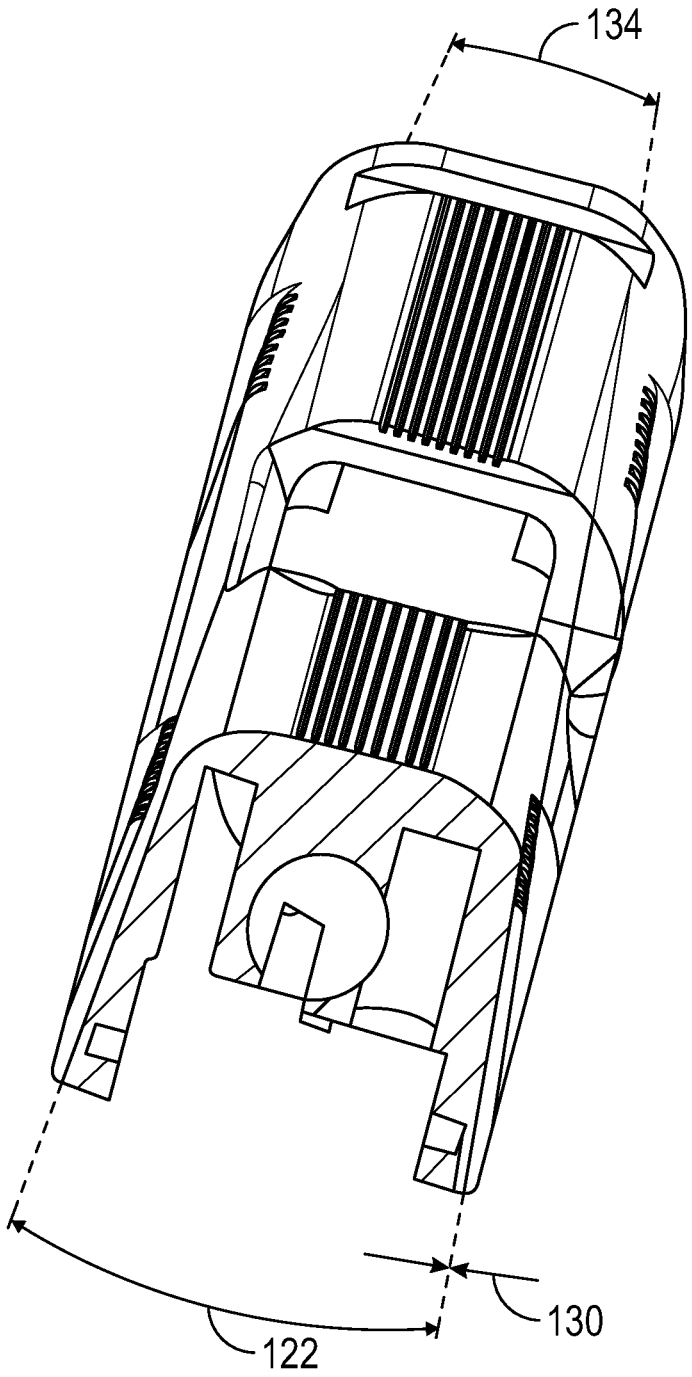
FIG. 12 is a front angled cross-section view illustration along section line I-I of FIG. 2.

FIG. 12 is a front angled cross-section view illustration along section line I-I 218 of FIG. 2. Distance "A" 130 is the rail thickness at section I-I 218. Distance "B" 132 is the angle of the serration cut at section I-I 218. Distance 114 is the slide cut angle at section I-I 218.

Figure 13:
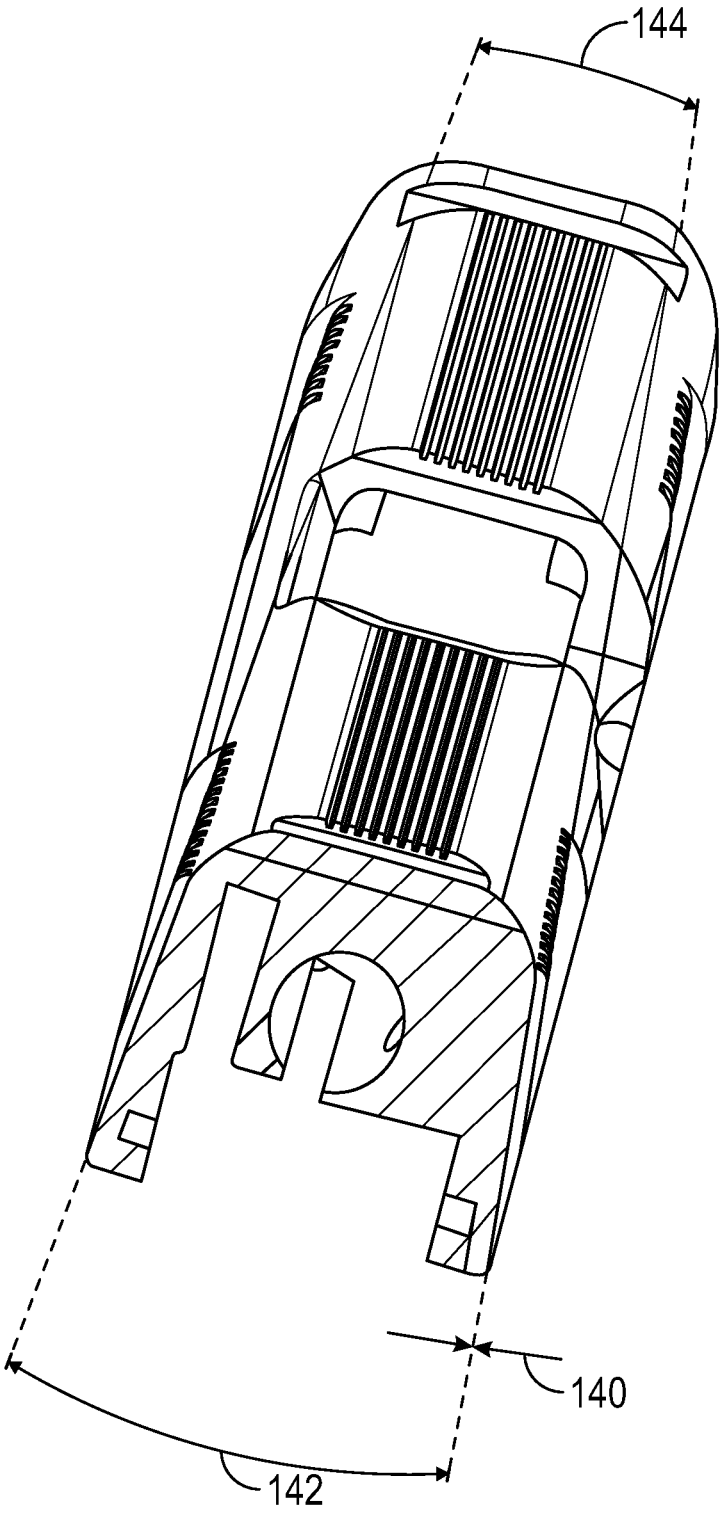
FIG. 13 is a front angled cross-section view illustration along section line J-J of FIG. 2.

FIG. 13 is a front angled cross-section view illustration along section line J-J 220 of FIG. 2. Distance "A" 140 is the rail thickness at section J-J 220. Distance "B" 142 is the angle of the serration cut at section J-J 220. Distance 144 is the slide cut angle at section J-J 220.

Figure 14:
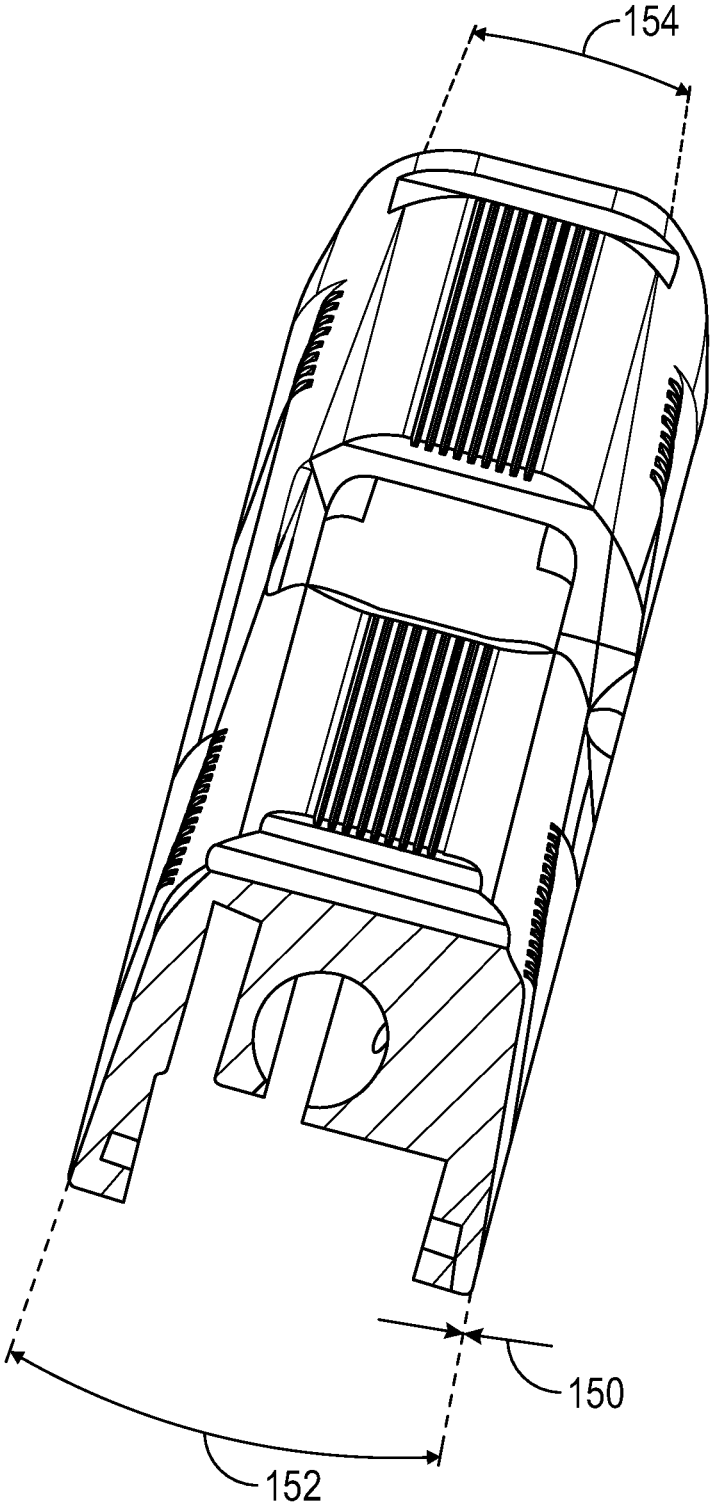
FIG. 14 is a front angled cross-section view illustration along section line K-K of FIG. 2.

FIG. 14 is a front angled cross-section view illustration along section line K-K 222 of FIG. 2. Distance "A" 150 is the rail thickness at section K-K 222. Distance "B" 152 is the angle of the serration cut at section K-K 222. Distance "C" 154 is the slide cut angle at section K-K 222.

Many modifications and other embodiments of the slide serrations described herein will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A pistol having a rail portion along which a slide moves translationally, the slide comprising a plurality of serrations having cut angles, wherein the plurality of serrations comprises groups of serrations separated by one or more unserrated portions of the slide, the serrations being configured by progressively varying cut angles to maximize the thickness of the slide portion in the rail portion.

2. A pistol having a rail portion along which a slide moves translationally, the slide comprising a plurality of serrations having cut angles, the slide having lateral sides and each lateral side has a height and each serration of the plurality of serrations being cut into the slide along the entire height of the lateral sides of the slide, wherein the slide defines a horizontal axis and the plurality of serrations are angled relative to the horizontal axis, the plurality of serrations comprises groups of serrations separated by one or more unserrated portions of the slide, and the serrations being configured by progressively varying cut angles to maximize the thickness of the slide portion in the rail portion.

* * * * *